US009543102B2

(12) United States Patent
Tachikawa et al.

(10) Patent No.: US 9,543,102 B2
(45) Date of Patent: Jan. 10, 2017

(54) ELECTROMAGNETIC SWITCH AND CONTACT POSITION REGULATING METHOD THEREOF

(71) Applicants: FUJI ELECTRIC FA COMPONENTS & SYSTEMS CO., LTD., Chuo-ku, Tokyo (JP); FUJI ELECTRIC CO., LTD., Kawasaki-shi (JP)

(72) Inventors: Hiroyuki Tachikawa, Yokohama (JP); Masaru Isozaki, Ichihara (JP); Osamu Kashimura, Hino (JP); Kouetsu Takaya, Kounosu (JP)

(73) Assignees: FUJI ELECTRIC FA COMPONENTS & SYSTEMS CO., LTD., Tokyo (JP); FUJI ELECTRIC CO., LTD., Kawasaki-shi (JP)

( * ) Notice: Subject to any disclaimer, the term of this patent is extended or adjusted under 35 U.S.C. 154(b) by 82 days.

(21) Appl. No.: 14/508,577

(22) Filed: Oct. 7, 2014

(65) Prior Publication Data

US 2015/0022292 A1 Jan. 22, 2015

Related U.S. Application Data

(63) Continuation of application No. PCT/JP2013/002475, filed on Apr. 11, 2013.

(30) Foreign Application Priority Data

Apr. 27, 2012 (JP) ..... 2012-103971

(51) Int. Cl.
*H01H 50/64* (2006.01)
*H01H 50/54* (2006.01)
(Continued)

(52) U.S. Cl.
CPC ..... *H01H 50/641* (2013.01); *H01H 1/34* (2013.01); *H01H 49/00* (2013.01); *H01H 50/54* (2013.01);
(Continued)

(58) Field of Classification Search
CPC ..... H01H 50/54; H01H 50/56; H01H 50/641; H01H 50/541; H01H 50/546
See application file for complete search history.

(56) References Cited

U.S. PATENT DOCUMENTS 3,942,143 A 3/1976 Pollmann et al.
5,145,057 A 9/1992 Hirota et al.
(Continued)

FOREIGN PATENT DOCUMENTS

CN 2232159 Y 7/1996
CN 101840816 A 9/2010
(Continued)

OTHER PUBLICATIONS

China Patent Office, "Office Action for Chinese Patent Application No. 201380019154.9," Feb. 2, 2016.
(Continued)

*Primary Examiner* — Bernard Rojas
(74) *Attorney, Agent, or Firm* — Manabu Kanesaka

(57) ABSTRACT

An electromagnetic switch includes a main contact housing portion housing a main contact mechanism having a pair of fixed contacts fixedly disposed maintaining a predetermined interval and a movable contact disposed to connect with and separate from the pair of fixed contacts in a contact housing case; an auxiliary contact housing portion housing at least two auxiliary contact mechanisms having fixed contacts and movable contacts disposed connecting to and separating from the fixed contacts; and an electromagnet unit having a movable plunger individually coupled to move the movable
(Continued)

contact of the main contact mechanism and the movable contacts of the auxiliary contact mechanisms. The main contact housing portion, the auxiliary contact housing portion, and the electromagnet unit are disposed in series.

17 Claims, 10 Drawing Sheets

(51) Int. Cl.
*H01H 50/56* (2006.01)
*H01H 1/34* (2006.01)
*H01H 49/00* (2006.01)

(52) U.S. Cl.
CPC ..... *H01H 50/541* (2013.01); *H01H 50/546* (2013.01); *H01H 50/56* (2013.01)

(56) References Cited

U.S. PATENT DOCUMENTS

| | | | |
|---|---|---|---|
| 5,892,194 | A | 4/1999 | Uotome et al. |
| 7,944,333 | B2 | 5/2011 | Swartzentruber et al. |
| 2004/0027776 | A1 | 2/2004 | Uotome et al. |
| 2009/0066450 | A1 | 3/2009 | Yano et al. |
| 2015/0318133 | A1 | 11/2015 | Lauraire et al. |

FOREIGN PATENT DOCUMENTS

| | | | | |
|---|---|---|---|---|
| DE | 1763462 | A1 * | 4/1972 | ..... H01H 47/002 |
| DE | 3011779 | A1 | 10/1981 | |
| GB | 1191698 | A | 5/1970 | |
| GB | 2127224 | A | 4/1984 | |
| JP | S48-44785 | B | 12/1973 | |
| JP | S62-180926 | A | 8/1987 | |
| JP | H09-259728 | A | 10/1997 | |
| WO | 2005/059939 | A1 | 6/2005 | |

OTHER PUBLICATIONS

Europe Patent Office, "Search Report for EP 13782147.6," Feb. 1, 2016.

Europe Patent Office, "Search Report for European Patent Application No. 13782147.6," Jul. 8, 2016.

PCT, "International Search Report for International Application No. PCT/JP2013/002475".

* cited by examiner

ELECTROMAGNETIC SWITCH AND CONTACT POSITION REGULATING METHOD THEREOF

CROSS-REFERENCES TO RELATED APPLICATIONS

The present application is a continuation application of PCT International Application No. PCT/JP2013/002475 filed Apr. 11, 2013, and claims priority from Japanese Application No. 2012-103971 filed Apr. 27, 2012.

TECHNICAL FIELD

The present invention relates to an electromagnetic switch including a main contact mechanism having a pair of fixed contacts and a movable contact, and auxiliary contact mechanisms having fixed contacts and movable contacts, and to a contact position regulating method thereof.

BACKGROUND ART

In some cases, a main contact mechanism that carries out conduction and interruption of a large current, and an auxiliary contact mechanism linked to the operation of the main contact mechanism, are provided in an electromagnetic switch such as an electromagnetic relay or electromagnetic contactor. An electromagnetic switch described in PTL 1 is known for providing a main contact mechanism and auxiliary contact mechanism in this way. The electromagnetic switch described in PTL 1 is such that a movable contact coupled by a coupling shaft to a movable plunger of an electromagnet unit is disposed between a pair of fixed contacts to be capable of contacting to and separating from the pair of fixed contacts. Further, an auxiliary contact terminal pusher is disposed to face the leading end of the coupling shaft protruding beyond the movable contact, and an auxiliary contact movable terminal is pressed by the auxiliary contact terminal pusher. The auxiliary contact movable terminal is such that the auxiliary contact is in an off-state in a state wherein the auxiliary contact terminal pusher is not being pressed by the coupling shaft, while the auxiliary contact is in an on-state in a state wherein the auxiliary contact terminal pusher is being pressed by the coupling shaft.

CITATION LIST

Patent Literature

PTL 1: U.S. Pat. No. 7,944,333

SUMMARY OF INVENTION

Technical Problem

However, the heretofore known example described in PTL 1 is such that the auxiliary contact mechanism is disposed in the vicinity of the fixed terminals of the main contact mechanism. Because of this, in order to isolate from the main contact mechanism, the contact size, number of contacts, and contact configuration are limited, and there is an unsolved problem in that the interruption limit value of the auxiliary contact mechanism is small, and contact lifespan is short. Also, there is also an unsolved problem in that the movable contact of the auxiliary contact mechanism is of a cantilever spring structure with low rigidity, there is considerable variation in gap dimension, and it is difficult to obtain mirror contact with the main contact mechanism. Furthermore, there is also an unsolved problem in that contact configuration is limited, and it is therefore not possible to meet the demands of various customers.

Therefore, the invention has been made in view of the unsolved problems of the heretofore known example, and has an object of providing an electromagnetic switch, and contact position regulating method thereof, such that there is considerable freedom of auxiliary contact mechanism configuration, and it is possible to reliably obtain mirror contact of a main contact mechanism and auxiliary contact mechanism.

Solution to Problem

In order to achieve the heretofore described object, a first aspect of an electromagnetic switch according to the invention is such that a main contact housing portion housing a main contact mechanism having a pair of fixed contacts fixedly disposed to maintain a predetermined interval and a movable contact disposed to be capable of contacting to and separating from the pair of fixed contacts in a contact housing case, an auxiliary contact housing portion housing two or more auxiliary contact mechanisms having fixed contacts and movable contacts disposed to be capable of contacting to and separating from the fixed contacts, and an electromagnet unit having a movable plunger individually coupled to move the movable contact of the main contact mechanism and the movable contacts of the auxiliary contact mechanisms, are disposed in series.

According to the first aspect, a main contact housing portion housing a main contact mechanism and an auxiliary contact housing portion housing a plurality of auxiliary contact mechanisms are disposed in series, and movable contacts of the main contact mechanism and auxiliary contact mechanisms are moved by a movable plunger of an electromagnet unit; thus, it is possible to increase the freedom of the auxiliary contact mechanism configuration, and as the movable contacts of the main contact mechanism and auxiliary contact mechanisms are individually coupled to the movable plunger, it is possible to obtain mirror contact of the main contact mechanism and auxiliary contact mechanisms.

Also, a second aspect of the electromagnetic switch according to the invention is such that the main contact housing portion and auxiliary contact housing portion are disposed in series with the auxiliary contact housing portion on the electromagnet unit side.

According to the second aspect, the auxiliary contact housing portion is disposed between the main contact housing portion and electromagnet unit; thus, it is possible to couple the movable contact of each auxiliary contact mechanism to the movable plunger of the electromagnet unit, and thus possible to dispose the plurality of auxiliary contact mechanisms sandwiching the axial direction of the movable plunger.

Also, a third aspect of the electromagnetic switch according to the invention is such that the auxiliary contact mechanism includes a fixed contact holding portion having insertion holes to hold the fixed contacts by insertion and formed separated in a moving direction of the movable contacts and facing in a direction perpendicular to the moving direction of the movable contacts, a movable contact holding portion holding the movable contacts via contact springs, and a coupling shaft coupled to the electromagnet unit movable plunger moving the movable contact holding portion. Further, the movable contact holding portion is supported by the coupling shaft so that the front and back are reversible as seen from the direction perpendicular to the moving direction, and the fixed contacts are disposed in the mutually facing insertion holes of the fixed contact holding portion so as to face from a side opposite to that of the contact springs on a movable contact side of the movable contact holding portion.

According to the third aspect, it is possible to select the disposition of each fixed contact with respect to the fixed contact holding portion in the direction in which the movable contact can move, and as the front and back of the movable contact holding portion are reversible, it is possible to set the contact configuration freely to an a contact or b contact.

Also, a fourth aspect of the electromagnetic switch according to the invention is such that the movable contact holding portion is configured to hold the movable contact with the contact spring on the electromagnet unit side in one end portion, and hold the movable contact with the contact spring on the main contact housing portion side in another end portion.

According to the fourth aspect, by the pressing force of the contact springs with respect to the movable contact being reversed between one end portion and another end portion of the movable contact holding portion, it is possible for one to be an a contact while the other is a b contact. Moreover, by reversing the front and back of the movable contact holding portion, it is possible to simultaneously change an a contact to a b contact and a b contact to an a contact.

Also, a fifth aspect of the electromagnetic switch according to the invention is such that the movable contact holding portion is configured to hold the movable contact with the contact spring on the electromagnet unit side in both end portions.

According to the fifth embodiment, it is possible for the plurality of auxiliary contact mechanisms to be, for example, mutually identical a contacts. Further, by reversing the front and back of the movable contact holding portion, it is possible to change the plurality of contact mechanisms to identical b contacts.

Also, a sixth aspect of the electromagnetic switch according to the invention is such that the movable contact holding portion is configured to hold the movable contact with the contact spring on the main contact housing portion side in both end portions.

According to the sixth embodiment, it is possible for the plurality of auxiliary contact mechanisms to be mutually identical to b contacts. Further, by reversing the front and back of the movable contact holding portion, it is possible to change the plurality of contact mechanisms to identical a contacts.

Also, a seventh aspect of the electromagnetic switch according to the invention is such that the movable plunger has an extension portion extending into the auxiliary contact housing portion, wherein the movable contact holding portion is screwed to the extension portion, and a position of the movable contact holding portion can be regulated in an axial direction.

According to the seventh aspect, it is possible to regulate the axial direction position of the movable contact holding portion with respect to an extension portion of the movable plunger, and thus possible to regulate the positions of the movable contacts of the auxiliary contact mechanisms with respect to the position of the movable contact of the main contact mechanism.

Also, an eighth aspect of the electromagnetic switch according to the invention is such that a rotation prevention member preventing rotation of the movable contact holding portion is disposed in the auxiliary contact housing portion.

According to the eighth aspect, it is possible to prevent the movable contact holding portion screwed to the movable plunger from rotating when the position is being regulated; thus, preventing the relationship of the movable contact and fixed contacts, in which the movable contact and fixed contacts are facing each other, from deviating.

Also, a ninth aspect of the electromagnetic switch according to the invention is such that the coupling shaft is screwed to the movable plunger, and a position of the coupling shaft can be regulated in the axial direction.

According to the ninth aspect, by the coupling shaft being rotated, the coupling shaft can be moved in the axial direction with respect to the movable plunger, and it is thus possible to carry out accurate mirror contact of the main contact mechanism and plurality of auxiliary contact mechanisms.

Also, a tenth aspect of the electromagnetic switch according to the invention is such that the auxiliary contact mechanism is formed of an a contact that is in contact in an engaged state of the main contact mechanism and a b contact that is in contact in a released state of the main contact mechanism.

According to the tenth aspect, it is possible to simultaneously configure auxiliary contact mechanisms having an a contact and b contact of differing contact configurations.

Also, an eleventh aspect of the electromagnetic switch according to the invention is such that the auxiliary contact mechanisms are formed of a plurality of a contacts.

According to the eleventh aspect, the auxiliary contact mechanisms can be formed of a plurality of a contacts.

Also, a twelfth aspect of the electromagnetic switch according to the invention is such that the auxiliary contact mechanisms are formed of a plurality of b contacts.

According to the twelfth aspect, the auxiliary contact mechanisms can be formed of a plurality of b contacts.

Also, a first aspect of an electromagnetic switch contact position regulating method according to the invention is such that an auxiliary contact housing portion housing two or more auxiliary contact mechanisms having fixed contacts and movable contacts disposed to be capable of contacting to and separating from the fixed contacts, and an electromagnet unit having a movable plunger coupled via a coupling shaft to the movable contact of the main contact mechanism and the movable contacts of the auxiliary contact mechanisms are disposed in series, and a state wherein a movable contact holding portion holding the movable contacts of the auxiliary contact mechanisms is screwed to the movable plunger and the coupling shaft is screwed to the movable plunger is created. In this state, the electromagnetic switch contact position regulating method includes a step of interposing a wipe amount regulating plate between the movable plunger and auxiliary contact housing portion, the wipe amount regulating plate corresponding to an amount of contact wipe between the fixed contacts and movable contacts of the main contact mechanism and auxiliary contact mechanisms at a released time, a step of turning the movable plunger, so that the fixed contacts and movable contacts of the auxiliary contact mechanisms are contacting each other, a step of turning the coupling shaft, so that the fixed contacts and movable contact of the main contact mechanism are contacting each other, and a step of removing the wipe amount regulating plate.

According to the first aspect, it is possible to individually regulate contact between the movable contact and the pair of fixed contacts of the main contact mechanism and contact between the movable contacts and the fixed contacts of the plurality of auxiliary contact mechanisms, and thus possible to reliably regulate mirror contact of the main contact mechanism and plurality of auxiliary contact mechanisms.

Also, a second aspect of the electromagnetic switch contact position regulating method according to the invention is such that a main contact housing portion housing a main contact mechanism having a pair of fixed contacts fixedly disposed maintaining a predetermined interval and a movable contact disposed to be capable of contacting to and separating from the pair of fixed contacts in a contact housing case, an auxiliary contact housing portion housing two or more auxiliary contact mechanisms having fixed contacts and movable contacts disposed to be contacting to and separating from the fixed contacts, and an electromagnet unit having a movable plunger coupled via a coupling shaft to the movable contact of the main contact mechanism and the movable contacts of the auxiliary contact mechanisms are disposed in series, and a state wherein a movable contact holding portion holding the movable contacts of the auxiliary contact mechanisms is screwed to the movable plunger and the coupling shaft is screwed to the movable plunger is created. In this state, the electromagnetic switch contact position regulating method includes a step of interposing a gap regulating plate between the movable plunger and auxiliary contact housing portion, the gap regulating plate corresponding to the gap between the fixed contacts and movable contacts of the main contact mechanism and auxiliary contact mechanisms at a released time, a step of turning the movable plunger, so that the fixed contacts and movable contacts of the auxiliary contact mechanisms are contacting each other, a step of removing the gap regulating plate and interposing a wipe amount regulating plate corresponding to the amount of contact wipe between the fixed contacts and movable contacts of the main contact mechanism and auxiliary contact mechanisms, a step of turning the coupling shaft, so that the fixed contacts and movable contact of the main contact mechanism are contacting each other, and a step of removing the wipe amount regulating plate.

Advantageous Effects of Invention

According to the invention, a main contact housing portion that houses a main contact mechanism, an auxiliary contact housing portion that houses a plurality of auxiliary contact mechanisms, and an electromagnet unit having a movable plunger that individually couples and moves movable contacts of the main contact mechanism and plurality of auxiliary contact mechanisms, are arrayed in series.

Because of this, there is considerable freedom of auxiliary contact mechanism contact configuration, and it is possible to reliably obtain mirror contact of the main contact mechanism and auxiliary contact mechanisms.

Also, according to the electromagnetic switch contact position regulating method, it is possible to regulate the contact positions of the movable contacts of the main contact mechanism and plurality of auxiliary contact mechanisms so that it is possible to reliably carry out mirror contact wherein the contacts with the fixed contacts of the movable contact of the main contact mechanism and movable contacts of the plurality of auxiliary contact mechanisms are carried out simultaneously.

DESCRIPTION OF EMBODIMENTS

Hereafter, based on the drawings, a description will be given of embodiments of the invention.

Figure 1:
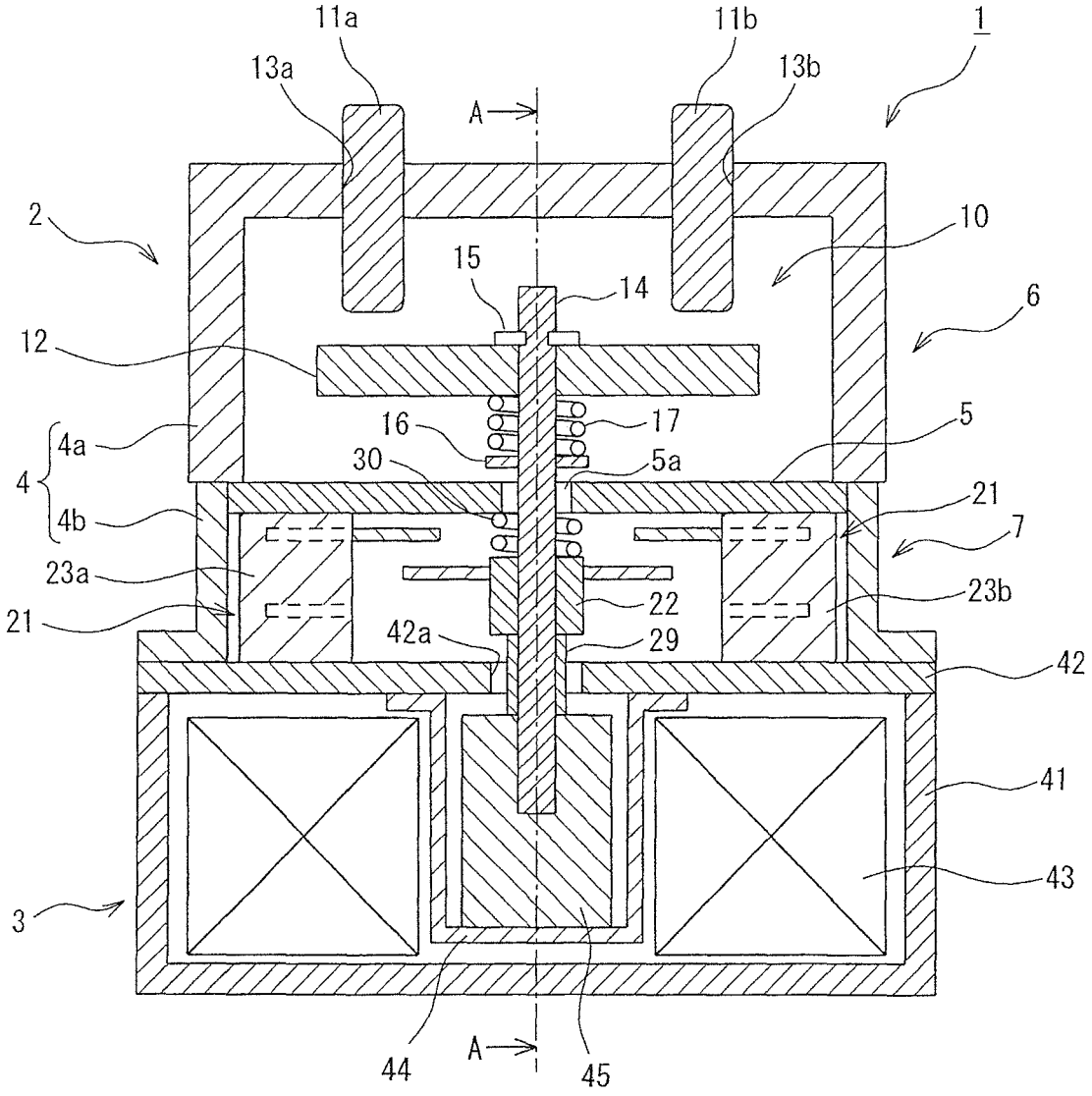
FIG. 1 is a sectional view showing a first embodiment of a case wherein the invention is applied to an electromagnetic contactor.

FIG. 1 is a sectional view showing an example of a case wherein a contact device of the invention is applied to an electromagnetic contactor acting as an electromagnetic switch. In FIG. 1, reference 1 is an electromagnetic contactor. The electromagnetic contactor 1 has a contact device 2 in which is disposed a contact mechanism, and an electromagnet unit 3 acting as an electromagnet device that drives the contact device 2, wherein the contact device 2 and electromagnet unit 3 are disposed in series.

The contact device 2 has an arc extinguishing chamber 4 acting as a contact housing case. The arc extinguishing chamber 4 is configured of a bottomed cylindrical tub-form body 4*a* formed of a ceramic, the lower end of which is opened, and a metal joining member 4*b* fixed in a hermetic state to the opened end surface. Further, the joining member 4*b* is fixed in a hermetic state by brazing, welding, or the like, to the upper surface of an upper magnetic yoke 42, to be described hereafter, of the electromagnet unit 3.

The arc extinguishing chamber 4 is divided horizontally by an isolating partition plate 5 fixed so as to close off the lower surface of the tub-form body 4*a*, wherein the upper portion is a main contact housing portion 6, and the lower portion is an auxiliary contact housing portion 7. The main contact housing portion 6 and auxiliary contact housing portion 7 are disposed in series with the electromagnet unit 3. An insertion hole 5*a* through which is inserted a coupling shaft 14, to be described hereafter, is formed in a central portion of the partition plate 5.

The main contact housing portion 6 houses in the interior thereof a main contact mechanism 10. The main contact mechanism 10 includes a pair of fixed contacts 11*a* and 11*b* made of a conductive metal, for example copper, and a movable contact 12 made of a conductive metal, for example copper, disposed so as to be capable of contacting to and separating from the pair of fixed contacts 11*a* and 11*b*.

Through holes 13*a* and 13*b* formed maintaining a predetermined interval in a longitudinal direction are provided in the upper surface of the tub-form body 4*a*, and the pair of fixed contacts 11*a* and 11*b* is inserted through the through holes 13*a* and 13*b* and fixed in a hermetic state by brazing, welding, or the like.

The upper ends of the pair of fixed contacts 11*a* and 11*b* protrude upward from the upper surface of the tub-form body 4*a*, and are connected to an unshown external connection terminal. The lower ends of the pair of fixed contacts 11*a* and 11*b* protrude inward to a predetermined length from the upper surface of the tub-form body 4*a*.

Figure 2:
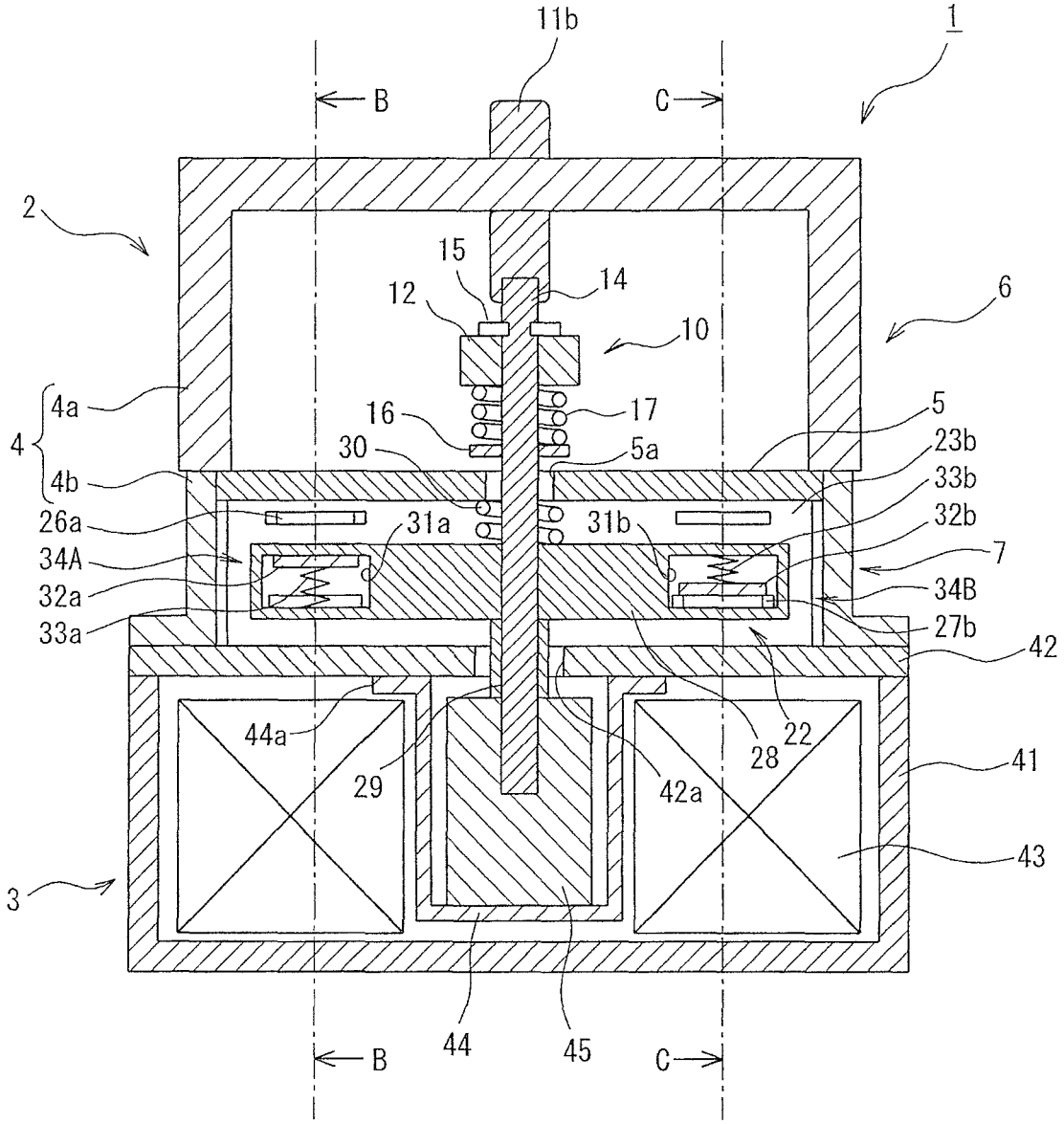
FIG. 2 is a schematic sectional view along the line A-A of FIG. 1.

Also, the movable contact 12 is formed of a flattened cuboid plate portion, as is clear by also referring to FIG. 2. The movable contact 12 is disposed so as to be movable in the axial direction in a coupling shaft 14 coupled to a movable plunger 45, to be described hereafter, of the electromagnet unit 3 and extending in the axial direction thereof. That is, the movable contact 12 is such that upward movement thereof is regulated by a retaining ring 15 configured of a C-ring or E-ring fixed to the coupling shaft 14, and the lower end surface is pressed upward by a contact spring 17 interposed between the lower end surface and a retaining ring 16 configured of a C-ring or E-ring fixed to the coupling shaft 14.

Figure 3:
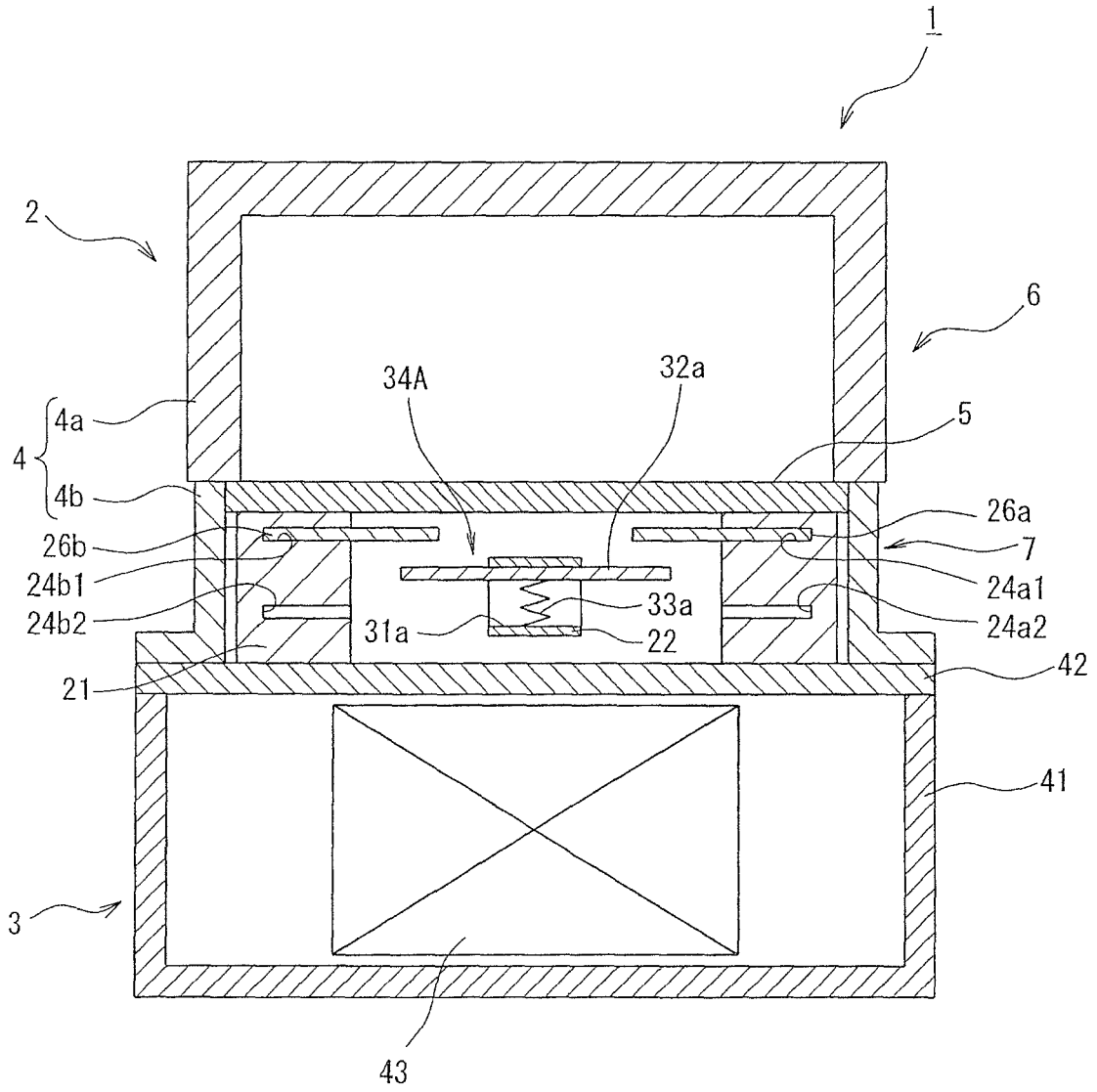
FIG. 3 is a sectional view along the line B-B of FIG. 2.
Figure 4:
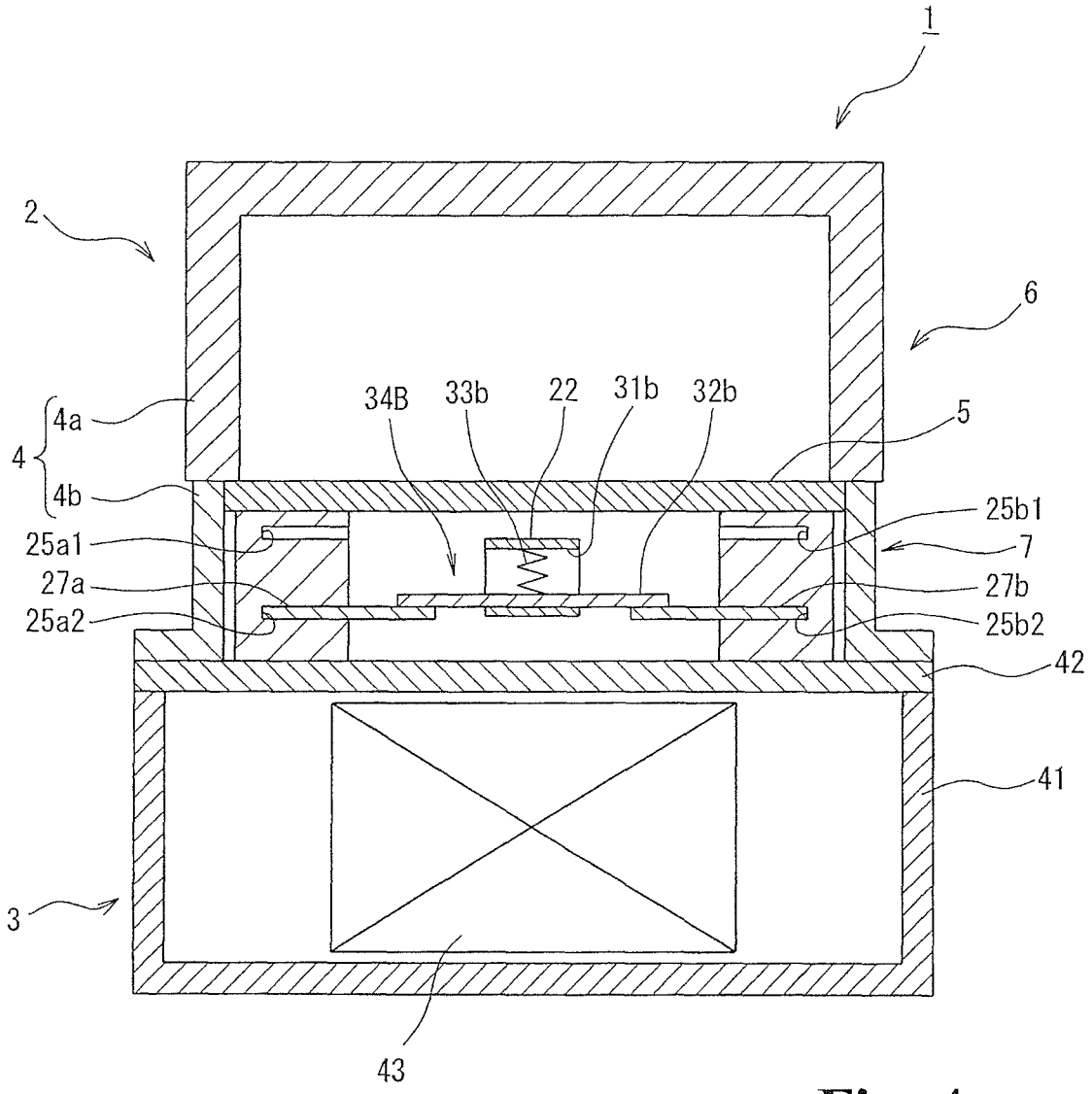
FIG. 4 is a sectional view along the line C-C of FIG. 2.
Figure 5:
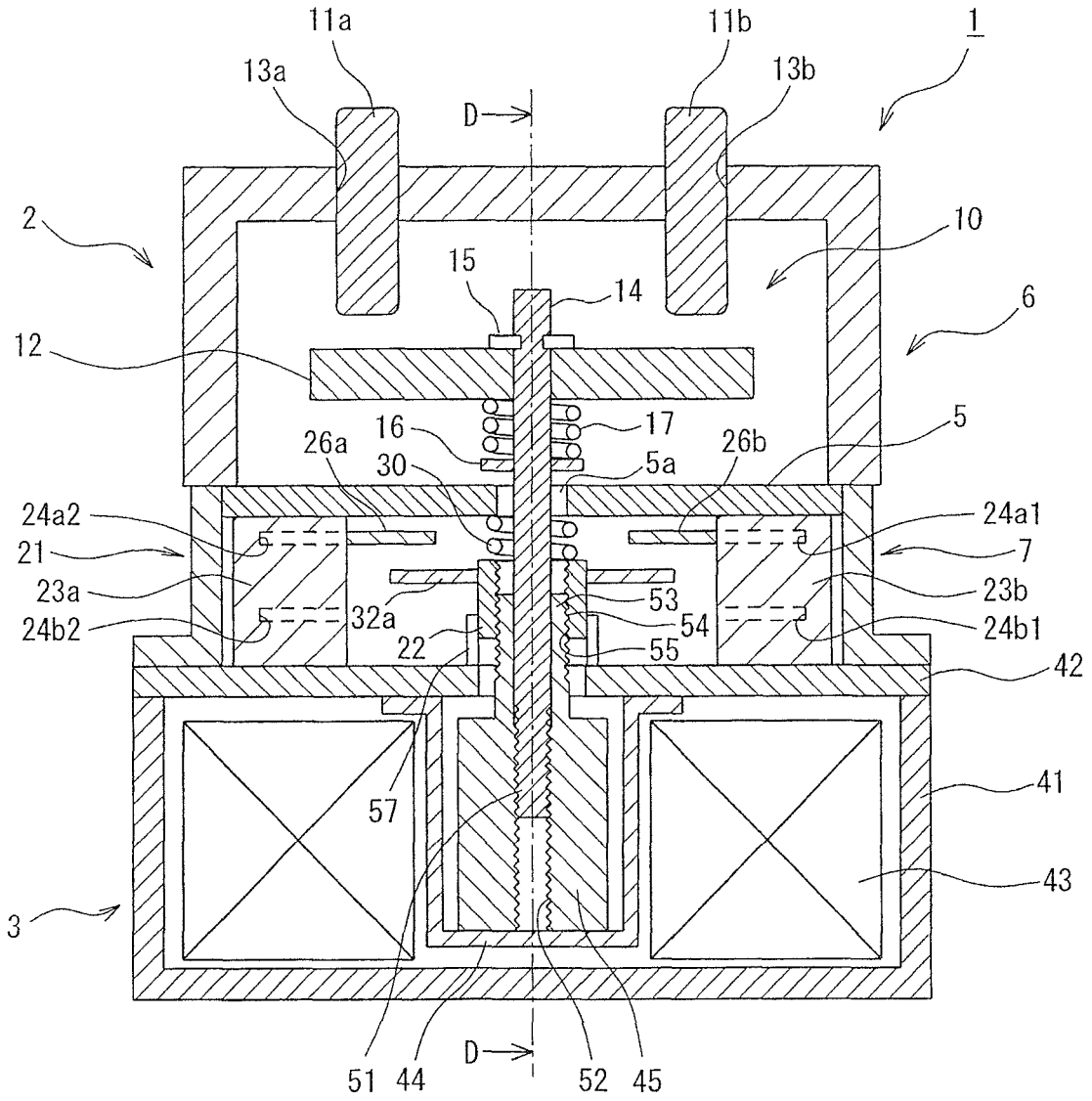
FIG. 5 is a sectional view showing a second embodiment of the invention.
Figure 6:
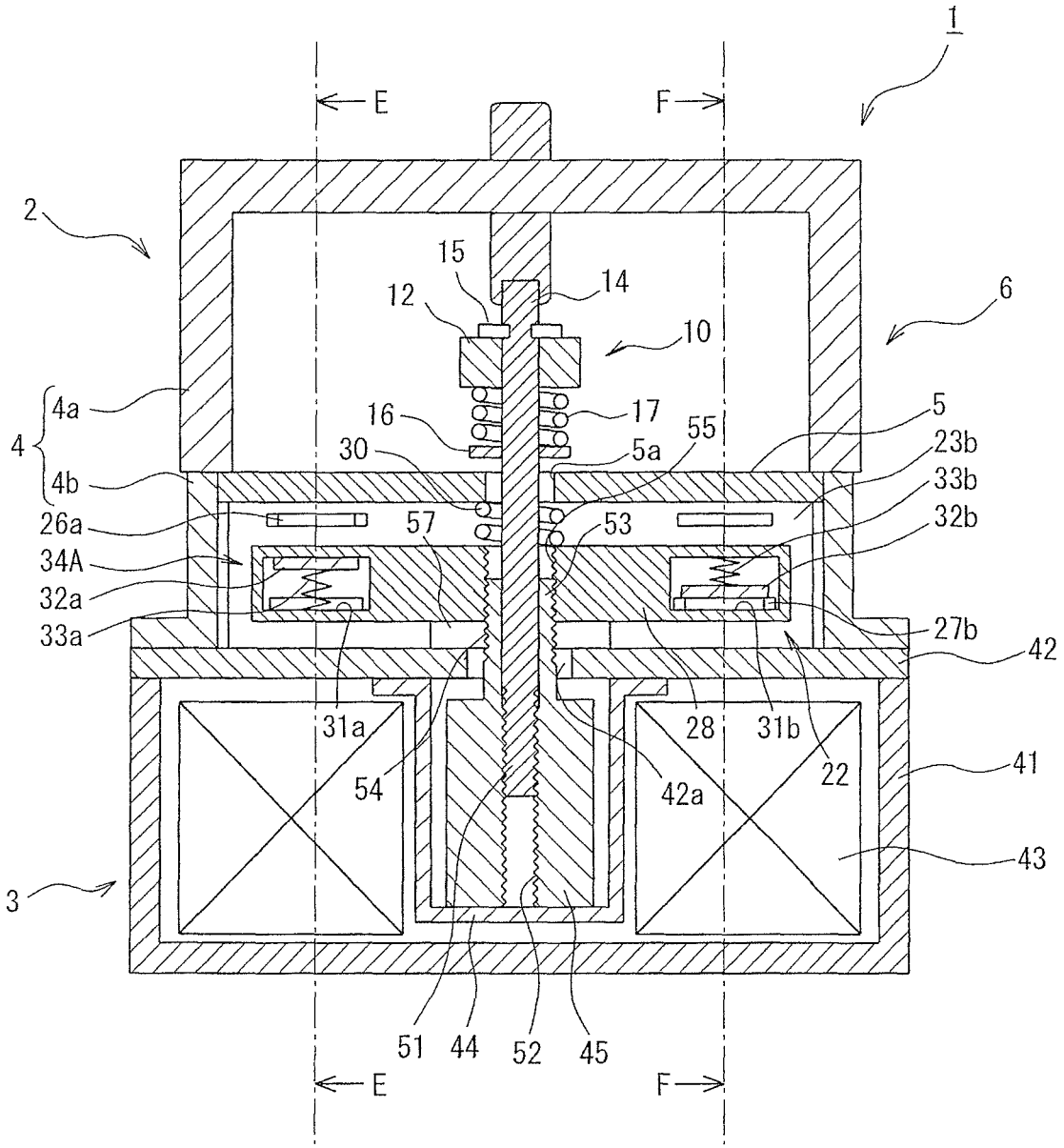
FIG. 6 is a sectional view along the line D-D of FIG. 5.
Figure 7:
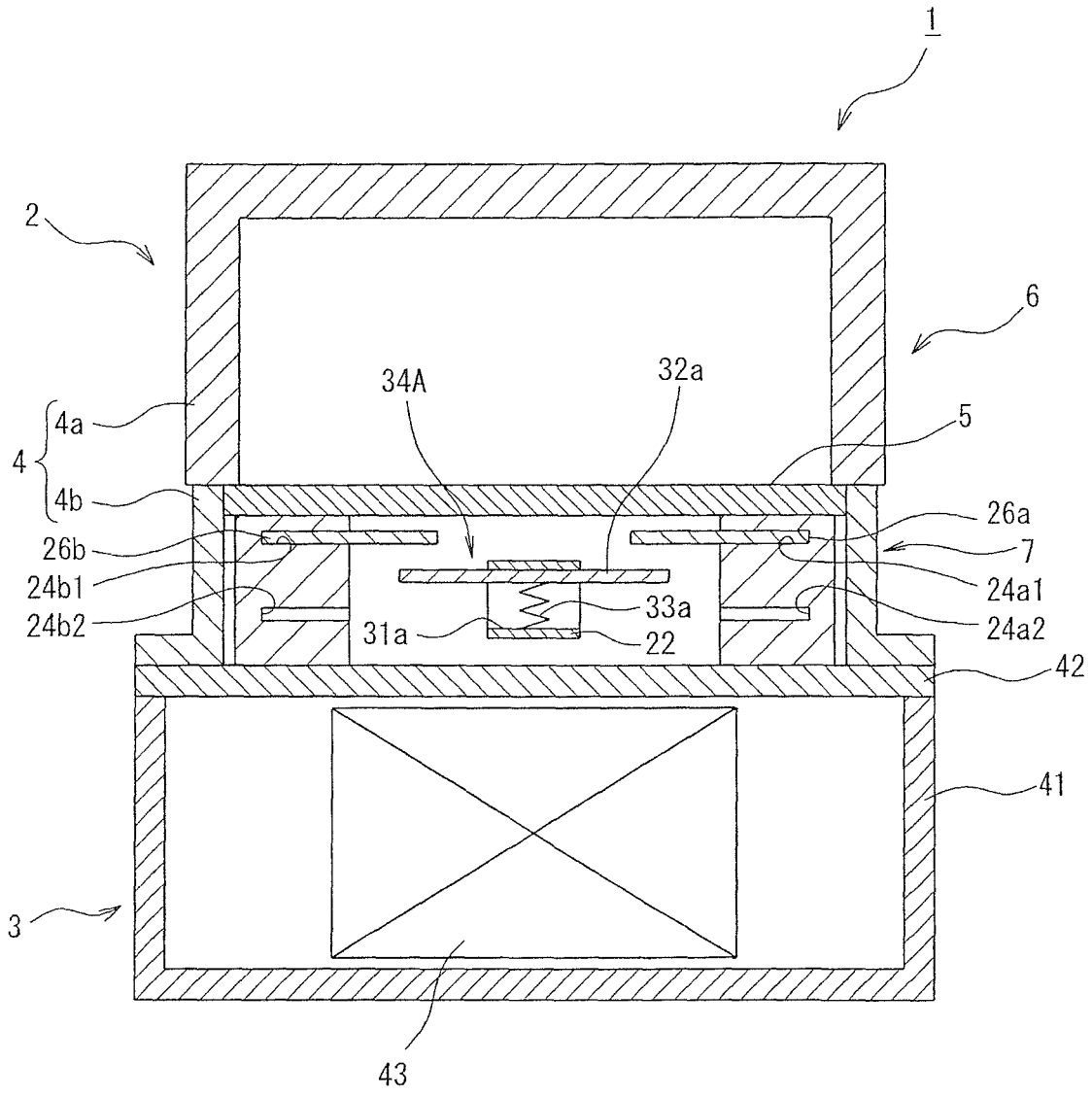
FIG. 7 is a sectional view along the line E-E of FIG. 6.
Figure 8:
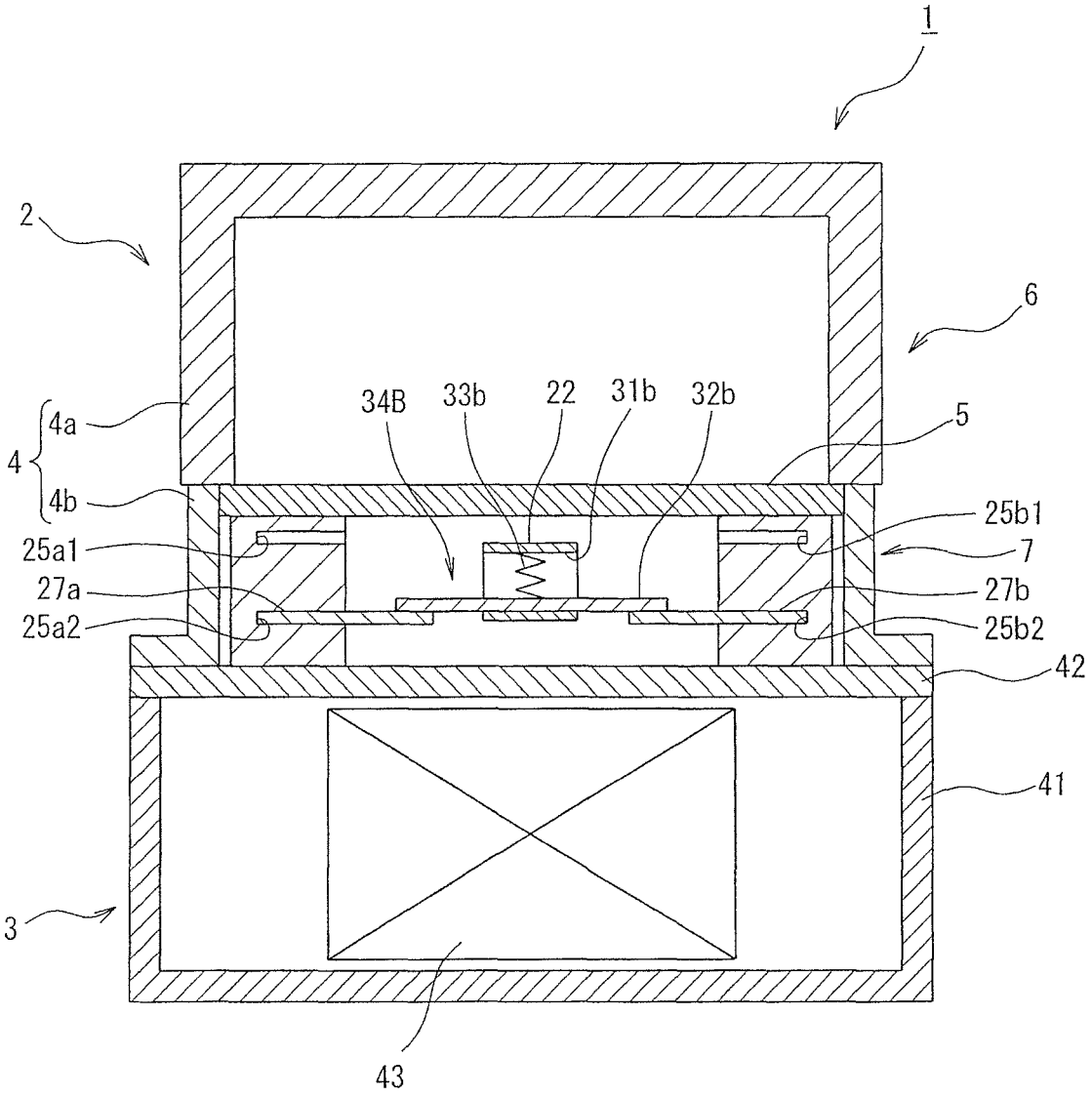
FIG. 8 is a sectional view along the line F-F of FIG. 6.
Figure 9A:
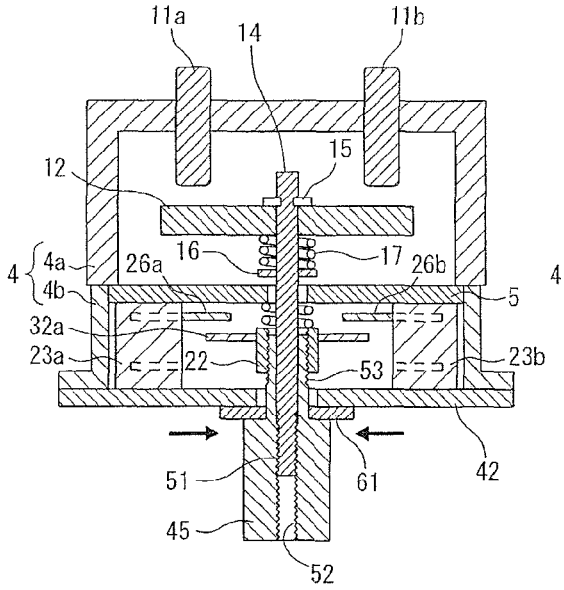
FIGS. 9(*a*)-9(*d*) are diagrams showing a contact position regulating method of an a contact according to the invention.
Figure 9B:
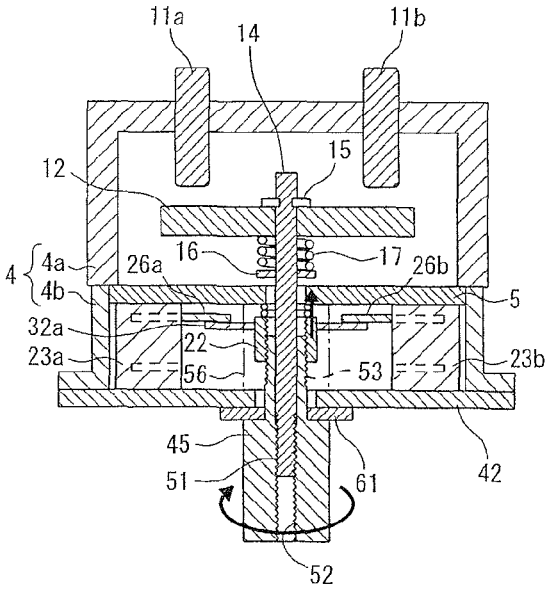
Figure 9C:
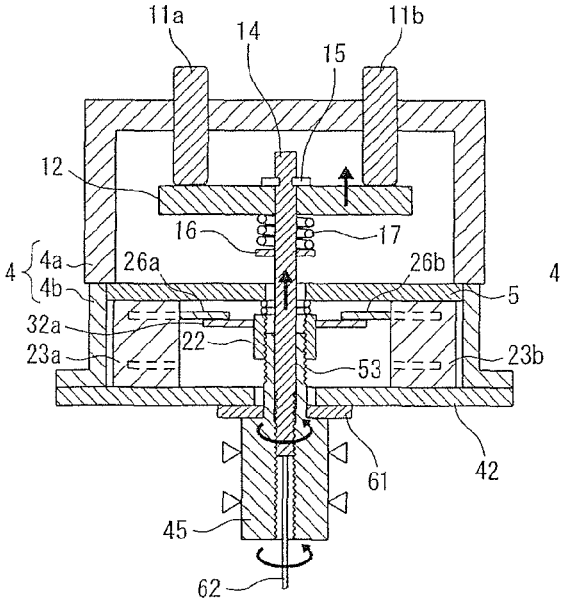
Figure 9D:
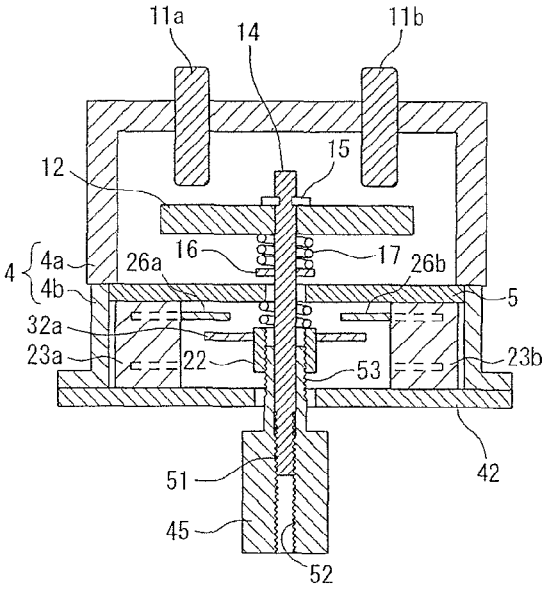
Figure 10A:
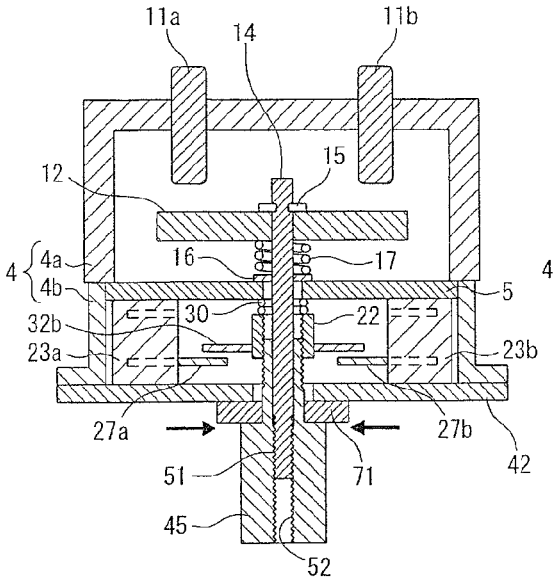
FIGS. 10(*a*)-10(*d*) are diagrams showing a contact position regulating method of a b contact according to the invention.
Figure 10B:
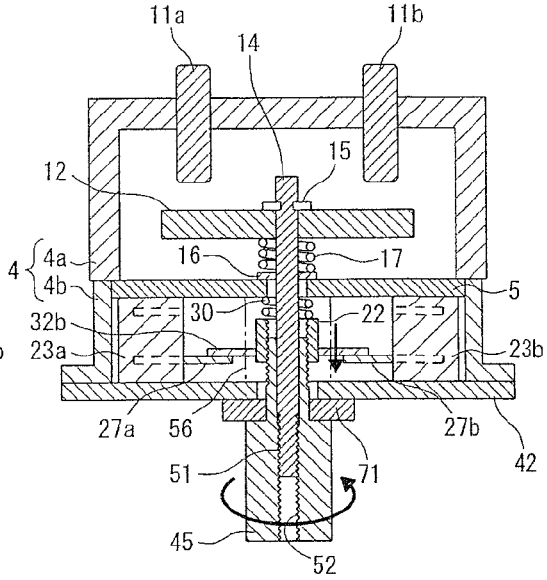
Figure 10C:
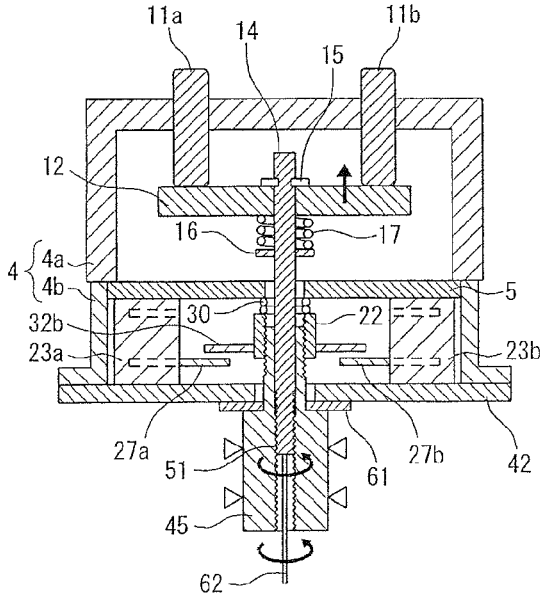
Figure 10D:
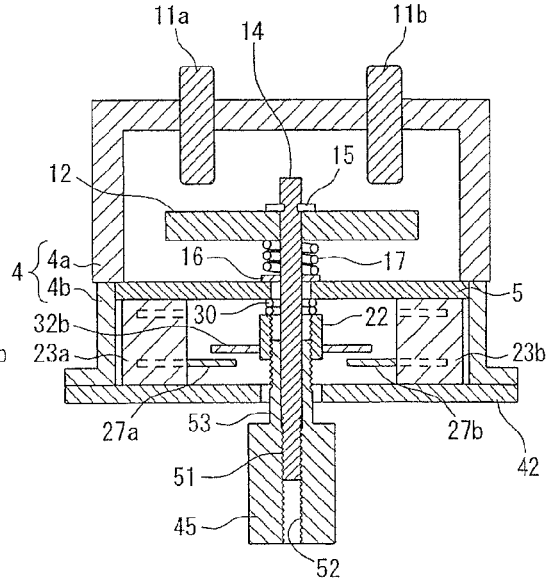

The auxiliary contact housing portion 7 has a fixed contact holding portion 21 shown in FIG. 3 and FIG. 4 and a movable contact holding portion 22 shown in FIG. 2.

The fixed contact holding portion 21 is disposed on the inner peripheral surface of the joining member 4*b*, as shown in FIG. 3 and FIG. 4. The fixed contact holding portion 21 has a left and right pair of holding plate portions 23*a* and 23*b* extending in a direction perpendicular to the extension direction of the movable contact 12 of the main contact mechanism 10. Contact insertion holes 24*a*1, 24*a*2 and 24*b*1, 24*b*2, and 25*a*1, 25*a*2 and 25*b*1, 25*b*2, are formed pierced, maintaining a predetermined interval in an up-down direction, in either end portion side in a front-back direction in the pair of holding plate portions 23*a* and 23*b*, as shown in FIG. 3 and FIG. 4.

Further, a pair of fixed contacts 26*a* and 26*b* is inserted into and held in one pair selected from the front side mutually facing contact insertion holes 24*a*1 and 24*b*1 and contact insertion holes 24*a*2 and 24*b*2, as shown in FIG. 3.

In the same way, a pair of fixed contacts 27*a* and 27*b* is inserted into and held in one pair selected from the front side mutually facing contact insertion holes 25*a*1 and 25*b*1 and contact insertion holes 25*a*2 and 25*b*2, as shown in FIG. 4.

The movable contact holding portion 22 has a holding plate portion 28, extending in a direction perpendicular to the movable contact 12 of the main contact mechanism 10, disposed around the coupling shaft 14, as shown in FIG. 2. Downward movement of the holding plate portion 28 is regulated by the upper end of a cylindrical body 29 fitted to the exterior of the coupling shaft 14 fixed to the movable plunger 45, to be described hereafter, of the electromagnet unit 3. The upper end of the holding plate portion 28 is pressed downward by a return spring 30 interposed between the holding plate portion 28 and the partition plate 5.

Contact holding holes 31*a* and 31*b* are formed in front and back end portion sides in the movable contact holding portion 22, penetrating in a left-right direction, as shown in FIG. 2. A movable contact 32*a* is pressed upward and held in the contact holding hole 31*a* by a contact spring 33*a* disposed on the lower side of the movable contact 32*a*, as shown in FIG. 2 and FIG. 3. A movable contact 32*b* is pressed downward and held in the contact holding hole 31*b* by a contact spring 33*b* disposed on the upper side of the movable contact 32*b*, as shown in FIG. 2 and FIG. 4.

Further, a first auxiliary contact mechanism 34A is configured of the fixed contacts 26*a* and 26*b* and movable contact 32*a*, while a second auxiliary contact mechanism 34B is configured of the fixed contacts 27*a* and 27*b* and the movable contact 32*b*. Consequently, the first auxiliary contact mechanism 34A and second auxiliary contact mechanism 34B are formed in positions of front-back symmetry sandwiching the coupling shaft 14.

Further, when the main contact mechanism 10 is in a released state wherein the movable contact 12 is separated downward from the fixed contacts 11*a* and 11*b* maintaining a predetermined gap, the first auxiliary contact mechanism 34A is of an a contact configuration wherein the movable contact 32*a* is separated from the fixed contacts 26*a* and 26*b* maintaining a predetermined gap.

Also, when the main contact mechanism 10 is in a released state, the second auxiliary contact mechanism 34B is of a b contact configuration wherein the movable contact 32*b* is contacting the fixed contacts 27*a* and 27*b* with the contact pressure of the contact spring 33*b*.

The electromagnet unit 3 has a magnetic yoke 41 of a flattened bottomed cylindrical form, and a disk form upper magnetic yoke 42 that closes off the opened end of the magnetic yoke 41, as shown in FIG. 1 and FIG. 2.

A cylindrical exciting coil 43 is disposed in the interior of the magnetic yoke 41, and a cap 44 formed in a bottomed cylindrical body form of a non-magnetic metal is disposed on the inner peripheral surface of the exciting coil 43.

A flange portion 44*a* extending outward is formed on the upper end of the cap 44, and the flange portion 44*a* is fixed in a hermetic state to the lower surface of the upper magnetic yoke 42 by brazing, welding, or the like.

The columnar movable plunger 45 is disposed so as to be movable in an up-down direction in the interior of the cap 44. The coupling shaft 14 is fitted into, and fixed in, an upper central position of the movable plunger 45. Also, the cylindrical body 29 is fixed around the coupling shaft 14 on the upper surface of the movable plunger 45.

Consequently, a sealed space is configured of the main contact housing portion 6, auxiliary contact housing portion 7, and cap 44, and an arc extinguishing gas such as hydrogen gas, nitrogen gas, a mixed gas of hydrogen and nitrogen, air, or $SF_6$ is encapsulated inside the sealed space.

Also, an insertion hole 42*a* through which are inserted the coupling shaft 14 and cylindrical body 29 is formed in a central portion of the upper magnetic yoke 42.

Next, a description will be given of an operation of the first embodiment.

Herein, it is assumed that the fixed contact 11*a* of the main contact mechanism 10 is connected via an external connection terminal (not shown) to, for example, a power supply source that supplies a large current, while the fixed contact 11*b* is connected via an external connection terminal (not shown) to a load.

In this state, the exciting coil 43 in the electromagnet unit 3 is in a non-exciting state, and no exciting force causing the movable plunger 45 to move is being generated in the electromagnet unit 3.

In this state, the movable plunger 45 is urged in a downward direction away from the upper magnetic yoke 42 by the return spring 30, and contacts a bottom portion of the cap 44, as shown in FIG. 1 and FIG. 2. Because of this, the movable contact 12 of the main contact mechanism 10 coupled to the movable plunger 45 via the coupling shaft 14 faces the fixed contacts 11*a* and 11*b* across a predetermined gap, forming an opened contact state wherein the fixed contacts 11*a* and 11*b* are electrically cut off.

In the released state of the main contact mechanism 10, the first auxiliary contact mechanism 34A is in an opened contact state wherein the movable contact 32*a* is separated downward by a predetermined gap from the fixed contacts 26*a* and 26*b*, and the fixed contacts 26*a* and 26*b* are electrically cut off from each other, as shown in FIG. 3.

In contrast, the second auxiliary contact mechanism 34B is in a closed contact state wherein the movable contact 32*b* is contacting the fixed contacts 27*a* and 27*b* due to the contact pressure of the contact spring 33*b*, as shown in FIG. 4.

On energizing the exciting coil 43 of the electromagnet unit 3 in the opened contact state of the main contact mechanism 10, an exciting force is generated in the electromagnet unit 3, and the movable plunger 45 is pressed upward against the return spring 30. In response to this, the movable contact 12 of the main contact mechanism 10 coupled via the coupling shaft 14 to the movable plunger 45 moves upward, and the movable contact 12 contacts the lower surfaces of the fixed contacts 11*a* and 11*b* with the contact pressure of the contact spring 17.

Because of this, a large current i of the external power supply source is supplied to the load via an external connection terminal (not shown), the fixed contact 11*a*, the movable contact 12, the fixed contact 11*b*, and an external connection terminal (not shown), creating an engaged state.

In the engaged state of the main contact mechanism 10, the first auxiliary contact mechanism 34A is in a closed contact state wherein the movable contact 32*a* is contacting the fixed contacts 26*a* and 26*b* with the contact pressure of the contact spring 33*b*, while the second auxiliary contact mechanism 34B is in an opened contact state wherein the movable contact 32*b* is separated downward by a predetermined gap from the fixed contacts 27*a* and 27*b*.

When interrupting the supply of current to the load in the closed contact state of the main contact mechanism 10, the energizing of the exciting coil 43 of the electromagnet unit 3 is stopped.

Because of this, there is no longer an exciting force in the electromagnet unit 3 causing the movable plunger 45 to move upward; thus, the movable plunger 45 descends due to the urging force of the return spring 30.

By the movable plunger 45 descending in this way, the movable contact 12 coupled via the coupling shaft 14 is contacting the fixed contacts 11*a* and 11*b* until there is no longer any contact pressure from the contact spring 17. Subsequently, an opened contact state wherein the movable contact 12 separates downward from the fixed contacts 11*a* and 11*b* is created at the point at which there ceases to be contact pressure from the contact spring 17.

On the opened contact state being created, an arc is generated between the fixed contacts 11*a* and 11*b* and movable contact 12. The arc generated is extended by the magnetic force of an unshown arc extinguishing permanent magnet, and extinguished.

In the first embodiment, a description has been given of a case of adopting a 1*a*1*b* contact configuration, wherein the first auxiliary contact mechanism 34A is of an a contact configuration and the second auxiliary contact mechanism 34B is of a b contact configuration.

However, the invention is such that it is possible, by disposing the movable contact holding portion 22 with the front and back reversed, and causing the fixed contacts 26*a*, 26*b* and 27*a*, 27*b* to be inserted into and held in the electromagnet unit 3 side contact insertion holes 24*a*2, 24*b*2 and 25*a*2, 25*b*2, to change the first auxiliary contact mechanism 34A to a b contact configuration and change the second auxiliary contact mechanism 34B to an a contact configuration.

Furthermore, in order to change the first auxiliary contact mechanism 34A from an a contact configuration to a b contact configuration, firstly, the up-down relationship of the movable contact 32*a* and contact spring 33*a* is reversed, putting the contact spring 33*a* on the electromagnet unit 3 side and the movable contact 32*a* on the main contact housing portion 6 side. In accordance with this, it is sufficient that the fixed contacts 26*a* and 26*b* are inserted into the electromagnet unit 3 side contact insertion holes 25*a*2 and 25*b*2. Because of this, the contact configuration of the first auxiliary contact mechanism 34A can be arbitrarily changed to one of an a contact or b contact.

Furthermore, in order to change the second auxiliary contact mechanism 34B from a b contact configuration to an a contact configuration, the up-down relationship of the movable contact 32*b* and contact spring 33*b* is reversed, putting the contact spring 33*b* on the electromagnet unit 3 side and the movable contact 32*b* on the main contact housing portion 6 side. In accordance with this, it is sufficient that the fixed contacts 27*a* and 27*b* are inserted into the main contact housing portion 6 side contact insertion holes 25*a*1 and 25*b*1. Because of this, the contact configuration of the second auxiliary contact mechanism 34B can be arbitrarily changed to one of an a contact or b contact.

In this way, according to the first embodiment, the main contact housing portion 6, auxiliary contact housing portion 7, and electromagnet unit 3 are disposed in series in that order. Because of this, the movable contacts 12, 32*a*, and 32*b* of the main contact housing portion 6 and auxiliary contact housing portion 7 can be moved by the one movable plunger 45, while reliably segregating the main contact housing portion 6 and auxiliary contact housing portion 7 in the axial direction.

Further, the coupling of the movable contacts 12, 32*a*, and 32*b* of the main contact housing portion 6 and auxiliary contact housing portion 7 with the movable plunger 45 is carried out via the individual coupling shaft 14 and cylindrical body 29. Because of this, the gaps between the fixed contacts 11*a*, 11*b* and 26*a*, 26*b*, 27*a*, 27*b* in the main contact mechanism 10 and auxiliary contact mechanisms 34A and 34B and the movable contacts 12 and 32*a*, 32*b* can be individually regulated.

Also, the first auxiliary contact mechanism 34A and second auxiliary contact mechanism 34B can be disposed in parallel in positions of front-back symmetry sandwiching the coupling shaft 14 and cylindrical body 29 in the auxiliary contact housing portion 7. Because of this, the two auxiliary contact mechanisms 34A and 34B can be operated without mutual interference, and it is thus possible to increase the interruption limit.

Furthermore, the main contact housing portion 6 and auxiliary contact housing portion 7 can be separated with the partition plate 5, and it is thus possible to reliably prevent the first auxiliary contact mechanism 34A and second auxiliary contact mechanism 34B being affected by metal vapor arising when an arc is generated in the main contact mechanism 10. Consequently, it is possible to increase the lifespan of the first auxiliary contact mechanism 34A and second auxiliary contact mechanism 34B, and thus possible to maintain contact reliability.

Furthermore, the first auxiliary contact mechanism 34A and second auxiliary contact mechanism 34B are such that an a contact configuration can be changed to a b contact configuration and a b contact configuration changed to an a contact configuration. In order to do this, it is sufficient that the insertion positions of the fixed contacts 26*a*, 26*b* and 27*a*, 27*b* in the contact insertion holes of the fixed contact holding portion 21 are changed, and that the front and back of the movable contact holding portion 22 are reversed, thus reversing the up-down positional relationship of the movable contacts 32*a* and 32*b* with the contact springs 33*a* and 33*b* in the movable contact holding portion 22 of the movable contacts 32*a* and 32*b*.

Furthermore, an a contact configuration can be adopted for both the first auxiliary contact mechanism 34A and second auxiliary contact mechanism 34B. In order to do this, it is sufficient that the movable contacts 32*a* and 32*b* are disposed on the main contact housing portion 6 side in the movable contact holding portion 22, the contact springs 33*a* and 33*b* are disposed and held on the electromagnet unit 3 side, and the fixed contacts 26*a*, 26*b* and 27*a*, 27*b* are disposed in the main contact housing portion 6 side contact insertion holes 24*a*1, 24*b*1 and 25*a*1, 25*b*1.

In the same way, a b contact configuration can be adopted for both the first auxiliary contact mechanism 34A and second auxiliary contact mechanism 34B. In order to do this, it is sufficient that the movable contacts 32*a* and 32*b* are disposed on the electromagnet unit 3 side in the movable contact holding portion 22, the contact springs 33*a* and 33*b* are disposed and held on the main contact housing portion 6 side, and the fixed contacts 26*a*, 26*b* and 27*a*, 27*b* are disposed in the electromagnet unit 3 side contact insertion holes 24*a*2, 24*b*2 and 25*a*2, 25*b*2.

In this way, according to the first embodiment, the contact configurations of the first auxiliary contact mechanism 34A and second auxiliary contact mechanism 34B can be set to be either an a contact configuration or b contact configuration, and it is thus possible to increase the freedom of the contact configuration considerably in comparison with the heretofore known example.

Next, based on FIG. 5 to FIG. 10, a description will be given of a second embodiment of the invention.

The second embodiment is such that the gap between the fixed contacts and movable contact of the main contact mechanism and the gaps between the fixed contacts and movable contacts of the auxiliary contact mechanisms can be individually regulated.

That is, the second embodiment is such that, in the configuration of FIG. 1 in the first embodiment, an external thread 51 is formed on the lower end of the coupling shaft 14, and the external thread 51 is screwed into an internal thread 52 formed in the movable plunger 45, as shown in FIG. 5 to FIG. 8. Also, the cylindrical body 29 is omitted, an extension portion 53 inserted through the insertion hole 42*a* of the upper magnetic yoke 42 and extending inside the auxiliary contact housing portion 7 is formed instead on the movable plunger 45, an external thread 54 is formed on the upper side outer peripheral surface of the extension portion 53, and an internal thread 55 formed in the movable contact holding portion 22 is screwed onto the external thread 54. A rotation prevention member 57 that prevents rotation of the movable contact holding portion 22 is disposed inside the auxiliary contact housing portion 7.

As configurations other than the heretofore described configurations are the same as in the first embodiment, the same reference signs are given to portions the same as in the first embodiment, and a detailed description thereof will be omitted.

According to the second embodiment, in the same way as the first embodiment, it is possible to dispose the plurality of auxiliary contact mechanisms 34A and 34B in the auxiliary contact housing portion 7, and possible to increase the freedom of the contact configurations of the first auxiliary contact mechanism 34A and second auxiliary contact mechanism 34B.

Also, according to the second embodiment, the coupling shaft 14 is screwed to the movable plunger 45, and the movable contact holding portion 22 of the auxiliary contact mechanisms 34A and 34B is screwed to the extension portion 53 of the movable plunger 45.

Consequently, it is possible to arbitrarily regulate the gap between the fixed contacts 11*a* and 11*b* of the main contact mechanism 10 and the movable contact 12, and possible to arbitrarily regulate the gaps between the fixed contacts 26*a*, 26*b* and 27*a*, 27*b* of the first auxiliary contact mechanism 34A and second auxiliary contact mechanism 34B and the movable contacts 32*a* and 32*b*.

Next, based on FIGS. 9(*a*)-9(*d*) and FIGS. 10(*a*)-10(*d*), a description will be given of a method of regulating the gaps in the main contact mechanism 10, first auxiliary contact mechanism 34A, and second auxiliary contact mechanism 34B.

With FIGS. 9(*a*)-9(*d*) and FIGS. 10(*a*)-10(*d*), a description will be given of a case wherein the first auxiliary contact mechanism 34A and second auxiliary contact mechanism 34B both have the same contact configuration, that is, an a contact configuration or a b contact configuration.

Firstly, when the first auxiliary contact mechanism 34A and second auxiliary contact mechanism 34B are of an a contact configuration, a contact wipe amount regulating plate 61 of, for example, a U-form or half-moon form is interposed between the upper magnetic yoke 42 and the upper end of the movable plunger 45 first, before the cap 44 is mounted, as shown in FIG. 9(*a*). The contact wipe amount regulating plate 61 is set to a thickness corresponding to a contact wipe amount representing the amount of movement of the movable contact holding portion 22 from the movable contacts 32*a* and 32*b* first contacting the fixed contacts 26*a*, 26*b* and 27*a*, 27*b* until a completely closed state in the a contact configuration.

In this state, by the movable plunger 45 being caused to rotate in a clockwise direction as seen in plan view, the movable contact holding portion 22 rises, and the movable contacts 32*a* and 32*b* contact the fixed contacts 26*a*, 26*b* and 27*a*, 27*b* with a predetermined contact pressure of the contact springs 33*a* and 33*b*, as shown in FIG. 9(*b*).

Next, with the movable plunger 45 in a fixed state, a tool 62 such as a screwdriver is inserted into the internal thread 52 of the movable plunger 45, and the coupling shaft 14 is rotated in a counterclockwise direction as seen in plan view, as shown in FIG. 9(*c*). By so doing, the movable contact 12 of the main contact mechanism 10 contacts the fixed contacts 11*a* and 11*b* with a predetermined contact pressure exerted by the contact spring 17.

Next, the contact wipe amount regulating plate 61 is removed, thus finishing the gap position regulation of the main contact mechanism 10 and auxiliary contact mechanisms 34A and 34B, as shown in FIG. 9(*d*).

After the gap position regulation is finished, the cap 44 is fixed in a hermetic state to the lower surface of the upper magnetic yoke 42 so as to enclose the movable plunger 45.

In this way, it is possible to complete regulation of the contact wipe amount of the main contact mechanism 10, and of the first auxiliary contact mechanism 34A and second auxiliary contact mechanism 34B. Because of this, it is possible to accurately regulate the gaps between the fixed contacts and movable contacts of the main contact mechanism 10 and the first auxiliary contact mechanism 34A and second auxiliary contact mechanism 34B. Consequently, it is possible to obtain accurate mirror contact of the main contact mechanism. 10 and the first auxiliary contact mechanism 34A and second auxiliary contact mechanism 34B.

Meanwhile, when the first auxiliary contact mechanism 34A and second auxiliary contact mechanism 34B are of a b contact configuration, a gap regulating plate 71 of, for example, a U-form or half-moon form, having a thickness the same as a predetermined gap formed between the fixed contacts 26*a*, 26*b* and 27*a*, 27*b* and the movable contacts 32*a* and 32*b* in the b contact configuration, is interposed between the upper magnetic yoke 42 and the upper end of the movable plunger 45 first, before the cap 44 is mounted, as shown in FIG. 10(*a*).

In this state, by the movable plunger 45 being caused to rotate in a clockwise direction as seen in plan view, the movable contact holding portion 22 rises, bringing the movable contacts 32*a* and 32*b* into an initial contact state contacting the fixed contacts 26*a*, 26*b* and 27*a*, 27*b*, as shown in FIG. 10(*b*).

Next, the gap regulating plate 71 is pulled out, and the contact wipe amount regulating plate 61 of, for example, a U-form or half-moon form, corresponding to a contact wipe amount representing the amount of movement of the movable contact holding portion 22 from the movable contacts 32*a* and 32*b* first contacting the fixed contacts 26*a*, 26*b* and 27*a*, 27*b* until a completely closed state, is interposed in place of the gap regulating plate 71, as shown in FIG. 10(*c*).

Next, with the movable plunger 45 in a fixed state, the tool 62, such as a screwdriver, is inserted into the internal thread 52 of the movable plunger 45, and the coupling shaft 14 is rotated in a counterclockwise direction as seen in plan view, because of which the movable contact 12 of the main contact mechanism 10 is brought into an initial contact state contacting the fixed contacts 11*a* and 11*b*.

Next, the contact wipe amount regulating plate 61 is removed, thus finishing the contact wipe amount regulation of the main contact mechanism 10 and auxiliary contact mechanisms 34A and 34B, as shown in FIG. 10(*d*).

After the contact wipe amount regulation is finished, the cap 44 is fixed in a hermetic state to the lower surface of the upper magnetic yoke 42 so as to enclose the movable plunger 45.

In this way, it is possible to complete contact wipe amount regulation and gap regulation of the main contact mechanism 10, and of the first auxiliary contact mechanism 34A and second auxiliary contact mechanism 34B. Because of this, it is possible to accurately regulate the amount of gap and amount of contact wipe between the fixed contacts and movable contacts of the main contact mechanism 10 and the first auxiliary contact mechanism 34A and second auxiliary contact mechanism 34B having a b contact configuration. Consequently, it is possible to obtain accurate mirror contact of the main contact mechanism 10 and the first auxiliary contact mechanism 34A and second auxiliary contact mechanism 34B.

Furthermore, in the embodiments, a description has been given of a case wherein the invention is applied to an electromagnetic contactor but, not being limited to this, the invention is also applicable to any electromagnetic switch including an electromagnetic relay or other instrument that electromagnetically carries out a switching operation.

INDUSTRIAL APPLICABILITY

According to the invention, it is possible to provide an electromagnetic switch, and contact position regulating method thereof, such that there is considerable freedom of auxiliary contact mechanism configuration, and it is possible to reliably obtain mirror contact of a main contact mechanism and auxiliary contact mechanisms.

REFERENCE SIGNS LIST

1 . . . Electromagnetic switch, 2 . . . Contact device, 3 . . . Electromagnet unit, 4 . . . Arc extinguishing chamber, 4*a* . . . Tub-form body, 4*b* . . . Joining member, 6 . . . Main contact housing portion, 7 . . . Auxiliary contact housing portion, 10 . . . Main contact mechanism, 11*a*, 11*b* . . . Fixed contact, 12 . . . Movable contact, 14 . . . Coupling shaft, 17 . . . Contact spring, 21 . . . Fixed contact holding portion, 22 . . . Movable contact holding portion, 24*a*1, 24*a*2, 24*b*1, 24*b*2, 25*a*1, 25*a*2, 25*b*1, 25*b*2 . . . Contact insertion hole, 26*a*, 26*b*, 27*a*, 27*b* . . . Fixed contact, 30 . . . Return spring, 32*a*, 32*b* . . . Movable contact, 33*a*, 33*b* . . . Contact spring, 34A . . . First auxiliary contact mechanism, 34B . . . Second auxiliary contact mechanism, 41 . . . Magnetic yoke, 42 . . . Upper magnetic yoke, 43 . . . Exciting coil, 44 . . . Cap, 45 . . . Movable plunger, 51 . . . External thread, 52 . . . Internal thread, 53 . . . Extension portion, 54 . . . External thread, 55 . . . Internal thread, 57 . . . Rotation prevention member, 61 . . . Contact wipe amount regulating plate, 71 . . . Gap regulating plate

What is claimed is:

1. An electromagnetic switch, comprising:

a main contact housing portion including in a contact housing case a main contact mechanism having a pair of main fixed contacts fixedly disposed to maintain a predetermined interval and a main movable contact disposed to contact with and separate from the pair of main fixed contacts;

an auxiliary contact housing portion including at least two auxiliary contact mechanisms having auxiliary fixed contacts and auxiliary movable contacts disposed to contact with and separating from the auxiliary fixed contacts, auxiliary fixed contact holding portions to hold the auxiliary fixed contacts, and an auxiliary movable contact holding portion to hold the auxiliary movable contacts via auxiliary contact springs;

an electromagnet unit having a movable plunger individually coupled to and moving the main movable contact of the main contact mechanism and the auxiliary movable contacts of the auxiliary contact mechanisms; and a position regulating mechanism to regulate a position of the auxiliary movable contact holding portion in respect to the movable plunger in a moving direction of the auxiliary movable contacts, wherein the main contact housing portion, the auxiliary contact housing portion, and the electromagnet unit are disposed in series.

2. The electromagnetic switch according to claim 1, wherein the main contact housing portion and the auxiliary contact housing portion are disposed in series with the auxiliary contact housing portion on an electromagnet unit side.

3. The electromagnetic switch according to claim 1, wherein each of the auxiliary fixed contact holding portions has insertion holes to hold the auxiliary fixed contacts and formed separated in the moving direction of the auxiliary movable contacts, and faces in a direction perpendicular to the moving direction of the auxiliary movable contacts, the movable plunger includes a coupling shaft moving the auxiliary movable contact holding portion, the auxiliary movable contact holding portion is supported by the coupling shaft so that front and back are reversible as viewed from the direction perpendicular to the moving direction, and the auxiliary fixed contacts are disposed in the insertion holes of the auxiliary fixed contact holding portion mutually facing each other to face from a side opposite to that of the auxiliary contact springs on a movable contact side of the auxiliary movable contact holding portion.

4. The electromagnetic switch according to claim 3, wherein the auxiliary movable contact holding portion is configured to hold the auxiliary movable contact with the auxiliary contact spring on an electromagnet unit side in one end portion, and hold the auxiliary movable contact with the auxiliary contact spring on a main contact housing portion side in another end portion.

5. The electromagnetic switch according to claim 4, wherein the auxiliary movable contact holding portion is configured to hold the auxiliary movable contact with the auxiliary contact spring on the electromagnet unit side in each of two end portions.

6. The electromagnetic switch according to claim 4, wherein the auxiliary movable contact holding portion is configured to hold the auxiliary movable contact with the auxiliary contact spring on the main contact housing portion side in each of two end portions.

7. The electromagnetic switch according to claim 3, wherein the movable plunger has an extension portion extending into the auxiliary contact housing portion, and the movable contact holding portion is screwed to the extension portion, and a position of the auxiliary movable contact holding portion is regulated in an axial direction.

8. The electromagnetic switch according to claim 7, wherein the auxiliary contact housing portion is disposed with a rotation prevention member preventing a rotation of the auxiliary movable contact holding portion.

9. The electromagnetic switch according to claim 3, wherein the coupling shaft is screwed to the movable plunger, and a position of the coupling shaft is regulated in an axial direction.

10. The electromagnetic switch according to claim 3, wherein the position regulating mechanism includes a cylindrical body arranged around the coupling shaft under the auxiliary movable contact holding portion to regulate the position of the auxiliary movable contact holding portion in the moving direction.

11. The electromagnetic switch according to claim 3, wherein the position regulating mechanism includes:

an extension portion extending from the movable plunger into the auxiliary contact housing portion and having a first external thread on an outer peripheral surface of the extension portion, and a first internal thread formed on an inner peripheral surface of the auxiliary movable contact holding portion to screw to the first external thread of the extension portion, wherein the movable plunger is screwed to the auxiliary movable contact holding portion through the extension portion so that the auxiliary movable contact holding portion rotates around the extension portion of the movable plunger to regulate a gap between the auxiliary fixed contacts and auxiliary movable contacts.

12. The electromagnetic switch according to claim 11, wherein the position regulating mechanism further includes:

a second external thread formed on an outer peripheral surface of the coupling shaft, and a second internal thread formed on an inner peripheral surface of the movable plunger to screw to the second external thread of the coupling shaft, and the coupling shaft is screwed to the movable plunger so that the coupling shaft rotates to extend from the movable plunger to regulate a gap between the pair of main fixed contacts and the main movable contact.

13. The electromagnetic switch according to claim 1, wherein the auxiliary contact mechanism includes an a-contact contacting in an engaged state of the main contact mechanism and a b-contact contacting in a released state of the main contact mechanism.

14. The electromagnetic switch according to claim 13, wherein the auxiliary contact mechanisms includes a plurality of a-contacts.

15. The electromagnetic switch according to claim 13, wherein the auxiliary contact mechanisms includes a plurality of b-contacts.

16. An electromagnetic switch contact position regulating method, comprising:

a step of preparing a main contact housing portion housing a main contact mechanism having a pair of main fixed contacts fixedly disposed to maintain a predetermined interval and a main movable contact disposed to contact with and separate from the pair of main fixed contacts in a contact housing case, an auxiliary contact housing portion housing at least two auxiliary contact mechanisms having auxiliary fixed contacts and auxiliary movable contacts disposed to contact with and separate from the auxiliary fixed contacts, and an electromagnet unit having a movable plunger coupled via a coupling shaft to the main movable contact of the main contact mechanism and the auxiliary movable contacts of the auxiliary contact mechanisms;

a step of arranging the main contact housing portion, the auxiliary contact housing portion, and the electromagnet unit in series;

a step of interposing a wipe amount regulating plate between the movable plunger and auxiliary contact housing portion, the wipe amount regulating plate corresponding to an amount of contact wipe between the main and auxiliary fixed contacts and main and auxiliary movable contacts of the main contact mechanism and auxiliary contact mechanisms at a released time, in a condition of screwing an auxiliary movable contact holding portion holding the auxiliary movable contacts of the auxiliary contact mechanisms to the movable plunger and screwing the coupling shaft to the movable plunger;

a step of turning the movable plunger so that the auxiliary movable contact contacts the auxiliary fixed contacts of the auxiliary contact mechanisms;

a step of turning the coupling shaft so that the main movable contact contacts the main fixed contacts of the main contact mechanism; and a step of removing the wipe amount regulating plate.

17. An electromagnetic switch contact position regulating method, comprising:

a step of preparing a main contact housing portion housing a main contact mechanism having a pair of main fixed contacts fixedly disposed to maintain a predetermined interval and a main movable contact disposed to contact with and separate from the pair of main fixed contacts in a contact housing case, an auxiliary contact housing portion housing at least two auxiliary contact mechanisms having auxiliary fixed contacts and auxiliary movable contacts disposed to contact with and separate from the auxiliary fixed contacts, and an electromagnet unit having a movable plunger coupled via a coupling shaft to the main movable contact of the main contact mechanism and the auxiliary movable contacts of the auxiliary contact mechanisms;

a step of arranging the main contact housing portion, the auxiliary contact housing portion, and the electromagnet unit in series;

a step of interposing a gap regulating plate between the movable plunger and auxiliary contact housing portion, the gap regulating plate corresponding to a gap between the main and auxiliary fixed contacts and main and auxiliary movable contacts of the main contact mechanism and auxiliary contact mechanisms at a released time, in a condition of screwing an auxiliary movable contact holding portion holding the auxiliary movable contacts of the auxiliary contact mechanisms to the movable plunger and screwing the coupling shaft to the movable plunger;

a step of turning the movable plunger so that the auxiliary movable contacts contact the auxiliary fixed contacts of the auxiliary contact mechanisms;

a step of removing the gap regulating plate and interposing a wipe amount regulating plate corresponding to an amount of contact wipe between the main and auxiliary fixed contacts and main and auxiliary movable contacts of the main contact mechanism and auxiliary contact mechanisms;

a step of turning the coupling shaft so that the main movable contact contacts the main fixed contacts of the main contact mechanism; and a step of removing the wipe amount regulating plate.

* * * * *